United States Patent [19]

Thompson

[11] 4,396,092

[45] Aug. 2, 1983

[54] ROOF SUPPORTED SCAFFOLD

[76] Inventor: H. Truett Thompson, 1821 Muse, Fort Worth, Tex. 76112

[21] Appl. No.: 253,715

[22] Filed: Apr. 13, 1981

Related U.S. Application Data

[63] Continuation-in-part of Ser. No. 143,595, Apr. 25, 1980, Pat. No. 4,300,657.

[51] Int. Cl.[3] ..... E04G 1/28; E04G 3/04; E04G 1/36

[52] U.S. Cl. ..... 182/38; 182/82; 182/150

[58] Field of Search ..... 182/36–39, 182/82, 150, 206, 117, 214, 145

[56] References Cited

U.S. PATENT DOCUMENTS

| | | | |
|---|---|---|---|
| 295,592 | 3/1884 | Subers | 182/82 |
| 460,501 | 9/1891 | Coburn | 182/39 |
| 786,054 | 3/1905 | Roy | 182/82 |
| 866,078 | 9/1907 | Sims | 182/82 |
| 921,431 | 5/1909 | Miller | 182/145 |
| 1,176,652 | 3/1916 | Clark | 182/38 |
| 2,692,168 | 10/1954 | Gregory | 182/12 |
| 2,844,187 | 7/1958 | Scoville | 182/36 |
| 3,305,113 | 2/1967 | Gardner | 182/150 |
| 3,340,960 | 9/1967 | Wilson | 182/117 |
| 3,425,510 | 2/1969 | Fedoryk | 182/117 |
| 3,472,338 | 10/1969 | Weidman | 182/82 |
| 3,603,431 | 9/1971 | Nameche | 182/206 |
| 3,910,380 | 10/1975 | Nameche | 182/206 |
| 4,078,633 | 3/1978 | Fahy | 182/82 |
| 4,143,743 | 3/1979 | Larson | 182/206 |
| 4,232,759 | 11/1980 | Jacobs | 182/117 |
| 4,300,657 | 11/1981 | Thompson | 182/38 |

*Primary Examiner*—Reinaldo P. Machado
*Attorney, Agent, or Firm*—James E. Bradley

[57] ABSTRACT

A scaffold has features that allow it to be supported vertically by connecting it to a building. The scaffold includes a pair of legs. Each leg will telescope to vary the length of the leg. A rail interconnects the legs. A worker's platform is carried by the rail below the rail. Rollers connected with the platform allow the platform to roll along the length of the rail. An adapter mounted to the top of each leg will insert under a depending member of the building roof to hold the legs vertically. The adapter is urged upward by a spring to maintain engagement.

9 Claims, 8 Drawing Figures

FIG. 5
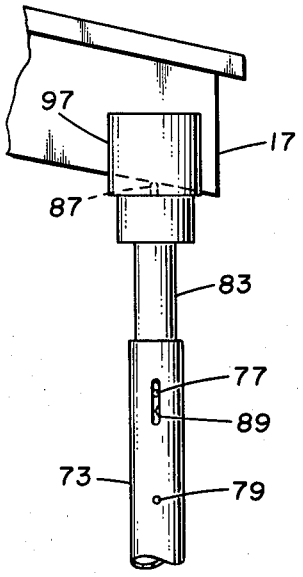
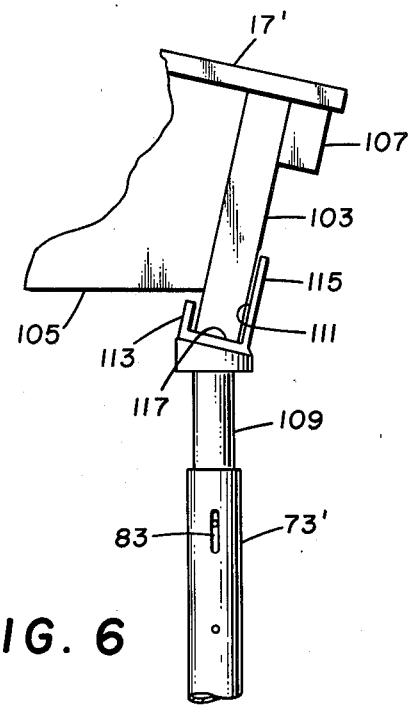
FIG. 6
FIG. 8
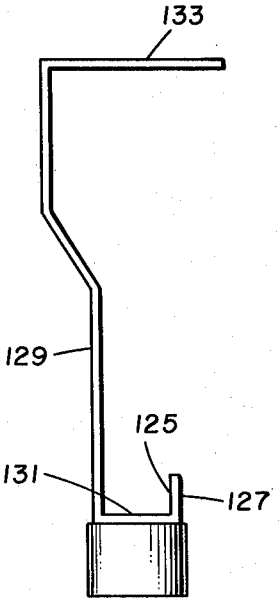
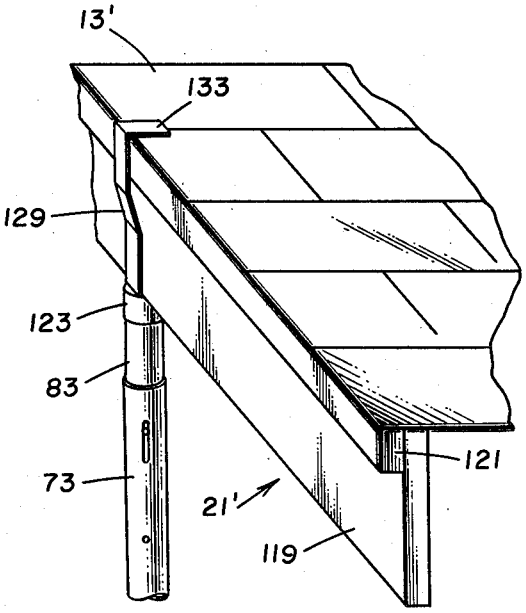
FIG. 7

ROOF SUPPORTED SCAFFOLD

CROSS-REFERENCE TO RELATED APPLICATION

This is a continuation-in-part of my copending patent application Ser. No. 143,595, filed Apr. 25, 1980 and entitled "Scaffold" and now U.S. Pat. No. 4,300,657.

BACKGROUND OF THE INVENTION

This invention relates in general to scaffolding for building construction and for repair, and in particular to means for supporting the scaffolding with the building.

In my copending patent application, Ser. No. 143,595, filed Apr. 25, 1980, I described a lightweight scaffolding that is easy to erect and convenient to use. This scaffolding has telescoping legs and a horizontal rail extending between the legs. A worker's platform depends from the rail. Rollers engage the rail to make the platform easy to roll along the length of the scaffolding. This scaffolding requires only two legs, and is supported by a standoff device that contacts the wall of the building, and supports the scaffolding in a leaning position.

While this scaffolding is successful, there are occasions in which a vertical scaffolding is preferred instead of one that leans toward the building. The only vertical scaffolding known to to applicant that is presently available is a stand-alone type. It has end frames that are from about 2½ to 5 feet wide. These are secured together by braces and a walk board about six feet long. This type of scaffolding is heavy and time consuming to erect, normally requiring more than one person.

SUMMARY OF THE INVENTION

In this invention, a vertical scaffolding is provided that requires only two legs, and is supported vertically by the building. The scaffolding is supported at the top by support means that engages a depending portion of the roof, such as an exposed rafter, a fascia board, or a gable end. Each leg has telescoping means to vary the length. A rail interconnects the legs. A worker's platform depends downwardly from the rail, with rollers at the rail to facilitate moving the platform along the length of the scaffold. The support means for supporting the scaffolding vertically by engaging the roof structure includes a channel for fitting under a depending portion of the roof and spring means for urging the channel upwardly into contact with the depending member.

BRIEF DESCRIPTION OF THE DRAWINGS

FIG. 5 is an enlarged side view, partially broken away, of the support means of the scaffold of FIG. 1.

FIG. 6 is another embodiment of the support means for the scaffold of this invention, shown engaging an inclined fascia board.

FIG. 7 is a perspective view of another embodiment of a support means for the scaffold of this invention, shown engaging a gable end.

FIG. 8 is an enlarged side view of the gable end support means of FIG. 7.

DESCRIPTION OF THE PREFERRED EMBODIMENT

Figure 1:
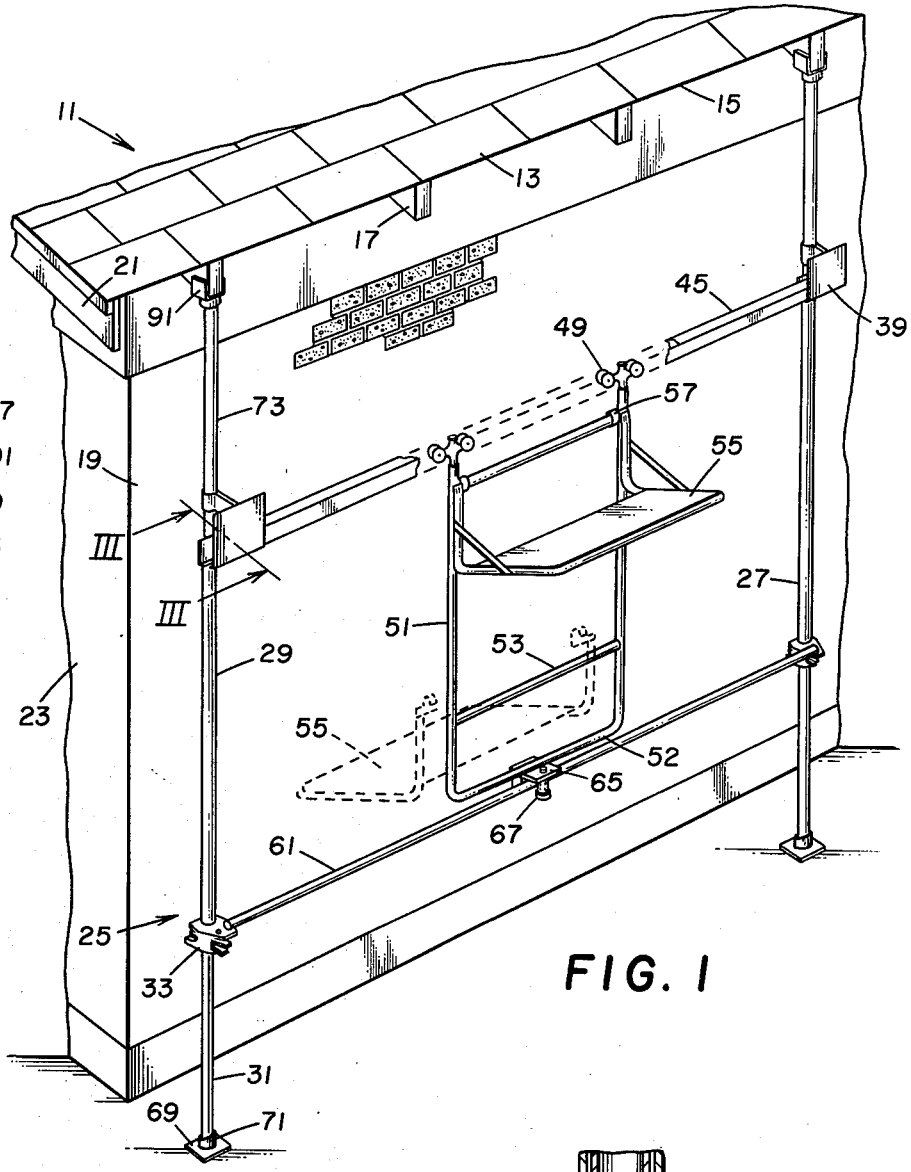
FIG. 1 is a perspective view illustrating an embodiment of the scaffold of this invention.

Referring to FIG. 1, a building 11 is shown of the type having a pitched roof 13 with overhanging eaves 15. Eaves 15 comprise depending members, which in this case are exposed ends of sloping rafters 17. The eaves 15 extend outwardly past the vertical wall 19 a short distance, normally from about 1 to 3 feet. Building 11 also has a gable end 21 that extends past a vertical wall 23 a short distance. Gable end 21 inclines upwardly to a gable or peak in the roof, while eaves 15 normally extend horizontally.

Scaffold 25 includes a pair of vertical legs 27 that are parallel to each other. Each leg 27 includes an outer member or tube 29 that receives an inner tube or rod 31 for serving as telescoping means for varying the length of the leg. The length of the inner rod 31 is greater than the length of tube 29.

Figure 4:
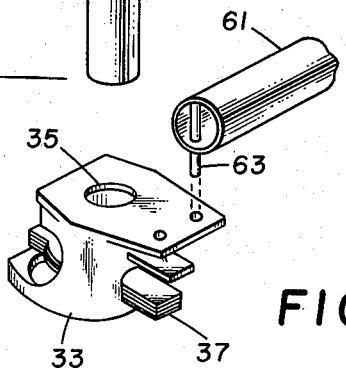
FIG. 4 is an enlarged perspective view of the pipe clamp used to vary the length of the legs of the scaffold of FIG. 1.

Locking means for locking the rod 31 to tube 29, shown also in FIG. 4, consists of a conventional pipe clamp 33, such as used for clamping furniture members together while gluing. Referring to FIG. 4, pipe clamp 33 has an inner bore 35 that slidingly receives the inner rod 31. Gripping means allows the rod 31 to slide downwardly with respect to pipe clamp 33, but prevents upward movement, unless released. In the pipe clamp shown in FIG. 4, the gripping means includes a plurality of plates 37, each having an aperture for receiving rod 31. The apertures in the plates 37 are slightly larger than the diameter of rod 31, and wedge rod 31 against movement in the upward direction with respect to pipe clamp 33. Plates 37 will release rod 31 for upward movement with respect to clamp 33 by pressing the ends of the plates 37 upward, to align the plates perpendicular to rod 31, and thus release the wedging action. The upper surface of pipe clamp 33 bears against the lower edge of tube 29, the tube having an outer diameter that is greater than the inner diameter of bore 35 of pipe clamp 33.

Figure 3:
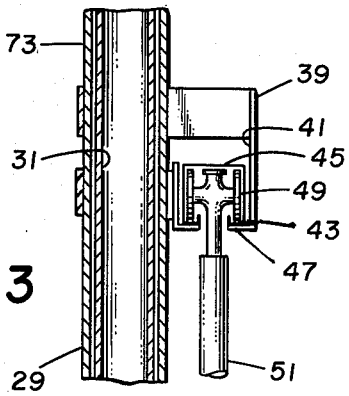
FIG. 3 is a vertical sectional view of the scaffold of FIG. 1 taken along the line III—III.

A rail bracket 39 is welded to tube 29 near its top. Referring to FIG. 3, rail bracket 39 has a socket that consists of a rectangular aperture 41 with a slot 43 in its bottom. Rail bracket 39 is adapted to receive a rail 45 in its aperture 41. Rail 45 is a rectangular tube having a slot 47 on its bottom. Each end of rail 45 will slide within the rail brackets 39, with the rail slot 47 aligning with the rail bracket slot 43. Each end of rail 45 and rail brackets 39 is open.

Referring to FIGS. 1 and 3, two tandem sets of rollers 49 are adapted to be carried in the rail 45. Each set of rollers 49 has four wheels; two wheels for engaging the rail surface or track located on one side of rail slot 47, and two wheels for engaging the track located on the other side of rail slot 47. Each set of rollers 49 has two axles, which support one end of a tubular depending frame 51. Frame 51 is bent into a "U" shape, with a lower horizontal base 53. The ends of frame 51 depend in a vertical plane, parallel with the legs 27 and building wall 19. The lengths of the ends of frame 51 are equal and about three feet, or slightly more than about one half the average height of a worker. Frame 51 includes two horizontal braces 53 that extend between the ends of frame 51, parallel and spaced above base 52.

A plate 55 has hooks 57 for slipping over one of the horizontal braces 53. Plate 55 extends horizontally outward from its hooks 57. As shown by the phantom lines, plate 55 can be placed on either the inner side or the outer side of scaffold 25. Plate 55 and frame 51 combine to define a platform for the worker to sit or stand.

A brace 61 extends between the legs 27 at a point about three feet below rail 45. As shown also in FIG. 4, brace 61 has depending pins 63 on each end for insertion within apertures drilled in the pipe clamps 33.

A tab 65 extends outwardly from the base 52 of frame 51. Tab 65 has a pair of depending and spaced-apart pins 67. Pins 67 have rotatable sleeves and are spaced-apart to insert loosely over brace 61 to serve as a retaining means for preventing plate 55 from swinging toward and away from building 11. Pins 67 allow the platform to be moved along the length of rail 45. Each leg 27 is supported by a rectangular plate 69, as shown in FIG. 1. Each plate 69 has a socket 71 that receives the lower end of one of the rods 31.

Figure 2:
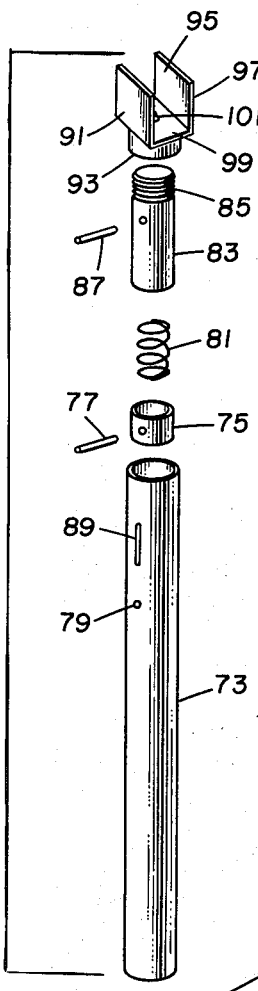
FIG. 2 is an enlarged perspective view of the support means of the scaffold of FIG. 1.

Referring to FIG. 1, a support means for supporting the legs 27 vertically includes a tube 73 that receives the upper end of rod 31 and rests on the top of tube 29. As shown also in FIG. 2, tube 73 is adapted to receive a collar 75 inside its bore. Collar 75 is pinned rigidly to tube 73 by a pin 77 that extends through an aperture 79 in tube 73. Collar 75 thus provides an upwardly facing shoulder. A coil spring 81 (FIG. 2), rests on top of the collar 75 inside tube 73. A tubular support member 83 is slidably carried inside tube 73 on top of coil spring 81. Support member 83 has threads 85 on its upper end and has an aperture through it for receiving a pin 87. Pin 87 extends laterally outwardly through an elongated slot 89 formed in the sidewall of tube 73. Pin 87 and slot 89 define an upper and lower limit of travel for the support member 83, and serve as a stop means for preventing the support member from disengagement with tube 73.

The upper end of support member 83 is adapted to receive one of several adapters for engaging a part of the roof 13. The adapter 91 shown in FIG. 1 is for use with exposed, depending rafters 17. It comprises a threaded socket 93 for engaging threads 85 of support member 83. A channel 95 faces upwardly and is secured to the top of socket 93. Channel 95 has two spaced-apart vertical sidewalls 97 and a horizontal base 99, that is normal to the axis of support member 83. The distance between sidewalls 97 is selected so that a conventional rafter 17 will be loosely received within the channel 95. A protruberance or pin 101, shown also in FIG. 5, is located in the base 99. Pin 101 is preferably conical and has a sharp peak or apex for embedding into the lower surface of a rafter 17.

In the operation of the embodiment shown in FIGS. 1–5, to erect the scaffold 25, each leg 27 will be positioned apart from the other and extended in length. Rod 31 will slide downwardly in tube 29 to provide the proper length. The channel 95 is placed near the outer end of a rafter 17. Pin 101, (FIG. 2) will embed into the lower surface of a rafter 17, being urged upward by spring 81. Once the legs are tightly in place, rail 45 is inserted into the rail brackets 39. Brace 61 is placed between the pipe clamps 33. The rollers 49 are inserted into the rail 45, with the frame 51 depending downwardly and the tab pins 67 inserted over the brace 61. Plate 55 is suspended on one of the braces 53, on either the inner or outer side, as desired.

While working from the scaffold 25 in this position, as shown in FIG. 5, the scaffold is prevented from falling inward by the pins 101. Also, if plate 55 is located on the outer side of scaffold 25, this will provide counterbalancing to prevent inward movement of the scaffold. Outward movement of the scaffold is prevented by pin 101 and also by the wedging action by the base 99 of the channel against the lower side of the rafter 17. The base 99, being horizontal will wedge against the inclined rafter 17 and thus be prevented from falling outward.

In FIG. 6, the rafters 17' do not have exposed outer ends. Instead, a fascia board 103 is secured across the outer ends of rafters 17'. In the embodiment of FIG. 6, fascia board 103 inclines with respect to the vertical at the angle at which the outer ends of rafters 17' have been cut. Often, a sheet 105 of plywood will extend from the fascia board 103 to the wall of the building, covering the rafters 17'. Also, often a small strip 107, such as a 1"×2" board, will be secured across the top of fascia board 103 and extend longitudinally.

For the roof structure of FIG. 6, an adapter 109 that differs from adapter 91 is used. The remaining portions of the supporting means are the same, but are indicated by prime symbols to differentiate the arrangement in FIG. 6 from the arrangement in FIGS. 1–5. Adapter 109 has a socket that is secured to the support member 83' inside tube 73'. An upwardly facing but inclined channel 111 is secured on top of adapter 109. Channel 111 has two parallel sidewalls 113 and 115 separated by a base 117. Base 117 does not contain a pin similar to pin 87 (FIG. 5). Sidewalls 113 and 115 incline at the same angle of inclination as fascia board 103, with respect to vertical. The axis of tube 73' intersects the planes containing sidewalls 113 and 115 at an acute angle. The inner sidewall 113 is of less height than the outer sidewall 115 so as to not interfere with cover 105.

In the operation of the embodiment of FIG. 6, the legs are secured vertically by extending them upwardly to insert channel 111 under fascia board 103. This places sidewall 111 parallel with fascia board 103 and on the outside, while sidewall 113 will be on the inside. The legs are extended until the coil spring inside tube 73' is compressed to some extent. If the fascia board 103 is vertical instead of inclined, an adapter similar to adapter 109, but oriented vertically, would normally be used.

Another embodiment is shown in FIGS. 7 and 8, this one being for use with the gable end 21'. Gable end 21' includes a fascia board 119 that depends downwardly in a vertical plane, and also slopes upwardly to a peak (not shown) of the roof. Often, a 1"×2" strip 121 will be located on the top and outer side of fascia board 119. The structure of FIG. 1 will be used for this arrangement, but for an adapter 123 that differs from the adapters 91 and 109 (FIG. 6). Adapter 123 has a threaded socket that is secured to the same support member 83" located in tube 73". Referring to FIG. 8, a channel 125 is located on the upper side. Channel 125 has an inner wall 127 and an outer wall 129 separated by a horizontal base 131 that is normal to the axis of support member 83". Outer wall 129 extends upwardly in a vertical plane, parallel with inner wall 127 for a selected distance. Then, to clear the strip 121, outer wall 129 inclines outwardly. At the top, outer wall 129 is bent at an angle to define an overhanging projection 133 that is located in a horizontal plane over and parallel with the base 131.

In the operation of the embodiment of FIGS. 7 and 8, the legs of the scaffold are extended until the channel 131 receives the fascia board 119 and compresses the spring in the support member 83" a certain extent. Projection 133 will be located above the roof 13'. The projection 133 prevents the legs from falling laterally toward each other before the rail 45 (FIG. 1) and brace 61 (FIG. 1) are inserted in place.

The invention has significant advantages. A light, easy to erect, vertical scaffold is provided. But for the platform plate, which will be located on the inner or outer side, the scaffold is essentially in a single plane and requires only two legs. The platform easily locks itself to any type of building with an overhanging roof, merely by changing the adapter at the top to accommodate exposed rafters, covered rafters, inclined fascia boards, vertical fascia boards, and gable ends. The positive connection to the roof provides a safe scaffold that will not overturn. If one leg embeds into the earth more than the other when in use, the spring in the support member will keep the lower leg in engagement with the roof.

While the invention has been shown in only three of its forms, it should be apparent to those skilled in the art that it is not so limited but is susceptible to various changes and modifications without departing from the spirit of the invention.

I claim:

1. A scaffolding apparatus, comprising:
a pair of legs;
telescoping means for varying the lengths of the legs;
a rail interconnecting the legs;
a worker's platform carried by the rail below the rail for movement along the rail between the legs; and
support means at the top of each leg for engaging a depending member of a builiding roof to support the legs vertically.

2. The apparatus according to claim 1 wherein the support means comprises:
a support member having a generally upwardly facing channel.

3. The apparatus according to claim 1 wherein the support means comprises:
a support member carried at the top of each leg and having a generally upwardly facing channel; and
spring means for urging the support member upwardly against the depending member.

4. A scaffolding apparatus, comprising:
a pair of tubular legs;
telescoping means for varying the lengths of the legs;
a rail interconnecting the legs;
a worker's platform carried by the rail below the rail for movement along the rail between the legs;
a cylindrical support member carried slidably inside each leg and protruding upwardly from the top of each leg;
a coil spring mounted inside each leg below each support member for urging the support member upwardly;
stop means adjacent the top of each leg for limiting the upward movement of each support member; and
an upwardly facing channel on top of each support member for insertion under a depending member of a building roof to support the legs vertically.

5. The apparatus according to claim 4 wherein the channel has a base and two parallel and spaced-apart sidewalls.

6. The apparatus according to claim 5 wherein a protuberance extends upwardly from the base of the channel and has a peak for embedding into the depending member of the building roof.

7. The apparatus according to claim 4 wherein the channel has two parallel spaced-apart sidewalls that are located in planes intersected at an acute angle by the axis of each leg, and wherein one sidewall is shorter than the other sidewall for location on the inner side of a fascia board.

8. The apparatus according to claim 4 wherein the channel has two spaced-apart sidewalls separated by a base, one of the sidewalls being greater in length than the other sidewall and having an overhanging projection extending above and over the base for fitting over the upper surface of a gable end.

9. A scaffolding apparatus, comprising:
a pair of legs, each leg having an inner cylindrical member slidably carried within an outer cylindrical member;
locking means for locking the inner member to the outer member at selected points to vary the lengths of the legs;
a pair of rail brackets, each mounted to one of the members, each rail bracket having a socket;
a rail adapted to slide into the sockets of the rail brackets, interconnecting the legs with the rail perpendicular to the legs, the rail having a horizontal surface extending the length of the rail for defining a track;
two sets of rollers carried on the track;
a worker's platform carried by the rollers;
a brace interconnecting the legs below and parallel with the rail;
retaining means engaging the brace with the platform for preventing the platform from swinging, but allowing the platform to move lengthwise with respect to the rail and the brace; and
support means at the top of each leg for engaging a depending member of a building roof to support the legs vertically, the support means including spring means for urging the support means upwardly into contact with the depending member.

* * * * *